US005876281A

United States Patent [19]

Hirasawa et al.

[11] Patent Number: 5,876,281

[45] Date of Patent: Mar. 2, 1999

[54] PULSE AIR JET GENERATOR

[75] Inventors: Kosuke Hirasawa, Soka; Kazuki Itakura, Misato; Taizo Shoji, Yashio, all of Japan; Yoshihide Isobe; Kenichi Yoneyama, both of Hillsboro, Oreg.

[73] Assignees: Air Tech Japan, Ltd., Tokyo, Japan; Airtech International Manufacturing, Inc., Hillsboro, Oreg.

[21] Appl. No.: 907,638

[22] Filed: Aug. 8, 1997

[30] Foreign Application Priority Data

Dec. 8, 1996 [JP] Japan ..... 8-229374

[51] Int. Cl.[6] ..... F24F 13/06

[52] U.S. Cl. ..... 454/305; 454/187; 454/284; 454/286

[58] Field of Search ..... 454/187, 284, 454/286, 305

[56] References Cited

U.S. PATENT DOCUMENTS

| | | | |
|---|---|---|---|
| 2,203,590 | 6/1940 | Bock | 454/305 |
| 5,161,317 | 11/1992 | McDougall | 34/97 |

FOREIGN PATENT DOCUMENTS

| | | | |
|---|---|---|---|
| 0 212 749 | 3/1987 | European Pat. Off. | 454/305 |
| 62-106247 | 5/1987 | Japan | 454/305 |
| 1216-581 | 3/1986 | U.S.S.R. | 454/284 |

*Primary Examiner*—Harold Joyce
*Attorney, Agent, or Firm*—Armstrong, Westerman, Hattori, McLeland, & Naughton

[57] ABSTRACT

A pulse air jet generator being used for an air shower apparatus. An air flow restricting member, which is so configured as to cross an air flow blown off from an air blowoff nozzle intermittently at part of the rotational locus thereof and to rotate by the air flow, is provided on the air blowoff side of the air blowoff nozzle, and the weight of a rotating portion including the air flow restricting member is unbalanced so that the air flow restricting member is reset to a position corresponding to that of the air blowoff nozzle by the dead weight when the air blowoff is stopped. The air blowoff nozzle is disposed in an annular frame fixed on an air blowoff portion at a position shifted to the outer peripheral side from the center of the annular frame, the rotational center of the air flow restricting member is positioned at the center of the annular frame.

6 Claims, 7 Drawing Sheets

PULSE AIR JET GENERATOR

BACKGROUND OF THE INVENTION

1. Field of the Invention

The present invention relates to a pulse air jet generator mainly used for an air shower apparatus.

2. Description of the Prior Art

The entrance to a working room usually kept in a clean environment, such as a clean room or bio-clean room, is provided with an air shower apparatus for removing dust and/or bacteria adhering on cloths of persons who will enter the working room. The air shower apparatus is, for example, so configured as shown in FIG. 11, in which a box-type main case 82 is partitioned by a bulkhead 83 into an air shower chamber 84 which forms a passage penetrating the central portion of the main case 82, and air cleaning chambers 85 provided on both the sides of the air shower chamber 84. In such an air shower apparatus, an air sucked through a pre-filter 86 into each air cleaning chamber 85 reduced in pressure by a blower 87 is press-fed into an air chamber 88, and thereafter, by pressurizing the inside of the air chamber 88, the air cleaned by means of a high performance filter 89 in the air chamber 88 is jetted from air blowoff nozzles (punkah nozzles) 90 into the air shower chamber 84, to thereby remove dust and the like adhering on the cloth of a person 91 in the air shower chamber 84.

In such an air shower apparatus indicated by reference numeral 81 in FIG. 11, it is presumed that much of dust particles adhering on the cloth of the person 91 are substantially instantly removed therefrom by the jetted air. This is supported by an experiment made for examining a relationship between an air jetting time and a dust removing effect. Specifically, the experiment shows the tendency in which the dust removing effect is saturated after an elapse of several seconds since start of air jetting. As a result, to more increase the dust removing efficiency after air jetting, it is necessary for the person 91 in the air shower chamber 84 to turn around himself or beat the cloth by the hands.

The above-described fact also shows that air jetting performed intermittently is superior to air jetting performed stationarily or continuously in terms of improvement in dust removing effect. Specifically, a pulse air jet formed by intermittent or pulsative air jetting makes it possible to repeatedly reproduce impact forces each of which is generated at start of air jetting and which is effective for dust removal, and hence to give vibrations similar to those generated when the person repeatedly beats the cloth by the hands.

FIG. 12 is a graph showing results of an experiment, in which air jetting using the same jetting nozzle is performed continuously, and intermittently at three pattern cycles: (1) ON (jetted) for one second/OFF (stopped) for two seconds; (2) ON for one second/OFF for one second; and (3ON for one second/OFF for 0.5 second, and dust removing efficiencies (%) for dust particles having particle sizes of (0.3) $\mu$m or more in the above conditions are measured. The experimental results show that the air jetting made intermittently at a short cycle is convenient for improving the dust removing efficiency.

The intermittent air jetting can be obtained by control of an air flow through opening/closing of a solenoid valve or damper; however, this method presents a problem that noise is enlarged with an increase in frequency of opening/closing actions and also the durability of the apparatus is degraded. Such a method causes another problem that provision of the solenoid valve or damper in each of a plurality of the air blowoff nozzles 90 opened toward the air shower chamber 84 complicates the entire configuration of the air shower apparatus and also increases the manufacturing cost and operating cost.

SUMMARY OF THE INVENTION

In view of the foregoing, the present invention has been made, and an object of the present invention is to provide a pulse air jet generator for generating a pulse air jet having a desired frequency, which is simple in structure without any additional power source, and is inexpensive.

To achieve the above object, according to the present invention, there is provided a pulse air jet generator including: an air flow restricting member, provided on the blowoff side of an air blowoff nozzle rotatably around a shaft being substantially in parallel to the blowoff direction, for crossing an air flow blown off from the air blowoff nozzle intermittently at part of the rotational locus of the air flow restricting member; wherein the air flow restricting member has partially or entirely an inclination angle with respect to the rotational direction thereof and is rotatable by the air flow blown off from the air blowoff nozzle.

The air flow restricting member may be formed of one or more of plates and the weight of a rotational portion containing the air flow restricting member may be unbalanced so that the plate or one of the plates of the air flow restricting member is reset to a position corresponding to that of the air blowoff nozzle by the dead weight when the air blowoff is stopped.

The air flow restricting member may be formed of one plate formed in a substantially semi-circular shape in a front view and positioned at a lower half of the rotational locus thereof by the dead weight in a state that the air blowoff is stopped; and the air blowoff nozzle may be disposed at a position, shifted sideward of the rotational center of the air flow restricting member, where the air blowoff nozzle is overlapped to the leading edge of the air flow restricting member in the rotational direction.

The air blowoff nozzle may be disposed in an annular frame at a position shifted to the outer peripheral side from the center of the annular frame, the annular frame being formed in a substantially cylindrical shape or in a substantially conical shape with the head cutoff and fixed on an air blowoff portion; and the rotational center of the air flow restricting member may be positioned at the center of the annular frame or in the vicinity thereof.

The pulse air jet generator preferably further includes a front cover which is provided on the blowoff side of the air blowoff nozzle and which has an air blowoff port provided at a position corresponding to that of the air blowoff nozzle, wherein the air flow restricting member may be disposed in a space formed between the front cover and the air blowoff nozzle.

The pulse air jet generator preferably further includes a movable nozzle member having an outer spherical surface portion supported by an inner spherical surface portion of the annular frame fixed on the air blowoff portion, wherein the air blowoff nozzle and the front cover having the air blowoff port are integrally formed on the air introduction side and the air blowoff side of the movable nozzle member respectively, and the air flow restricting member is disposed between the air blowoff nozzle and the front cover.

BRIEF DESCRIPTION OF THE DRAWINGS

FIGS. 5A and 5B are front views of essential portions of the pulse air jet generator according to the first embodiment, wherein FIG. 5A shows an air flow restricting member changed in shape from that shown in FIG. 4 and FIG. 5B shows an air blowoff nozzle changed in position from that shown in FIG. 4;

DESCRIPTION OF THE PREFERRED EMBODIMENTS

Hereinafter, preferred embodiments of the present invention will be described with reference to the drawings.

Figure 1:
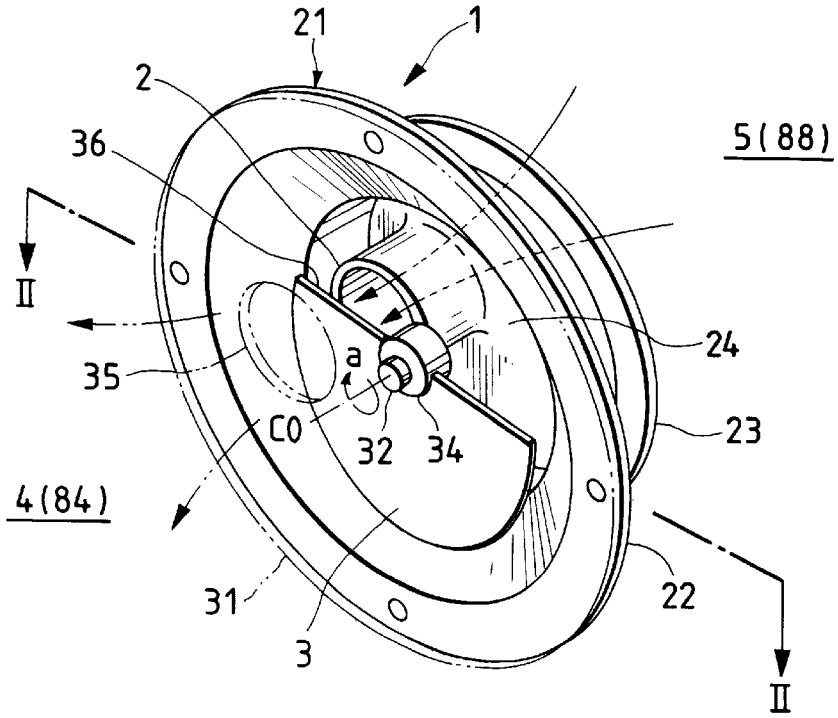
FIG. 1 is a perspective view of a pulse air jet generator according to a first embodiment of the present invention.
Figure 2:
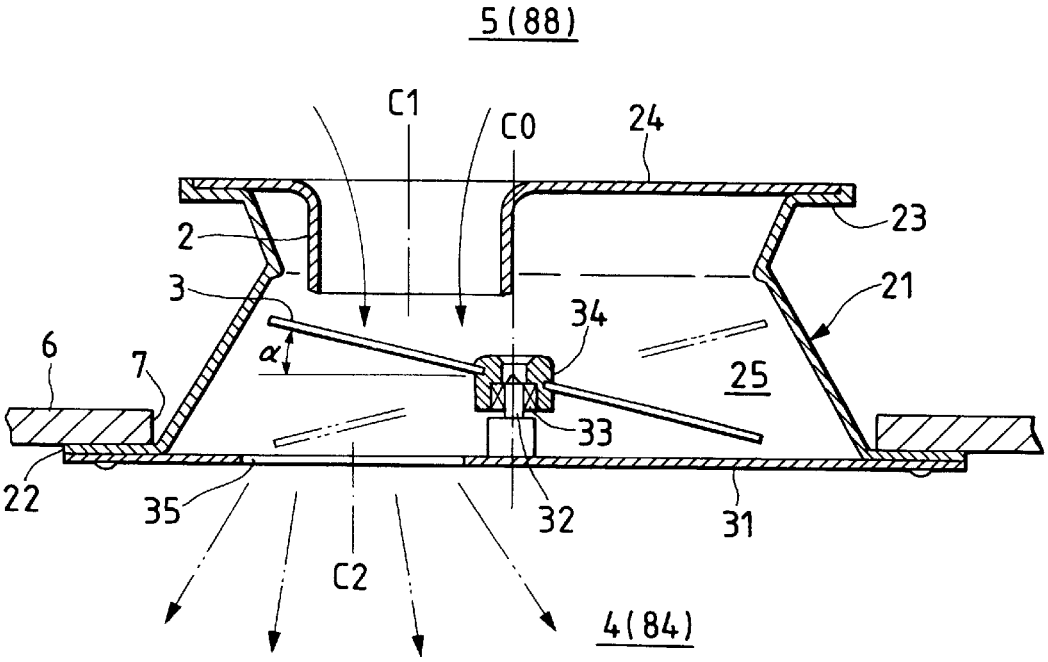
FIG. 2 is a sectional view taken on line II—II of FIGS. 1 and 3.
Figure 3:
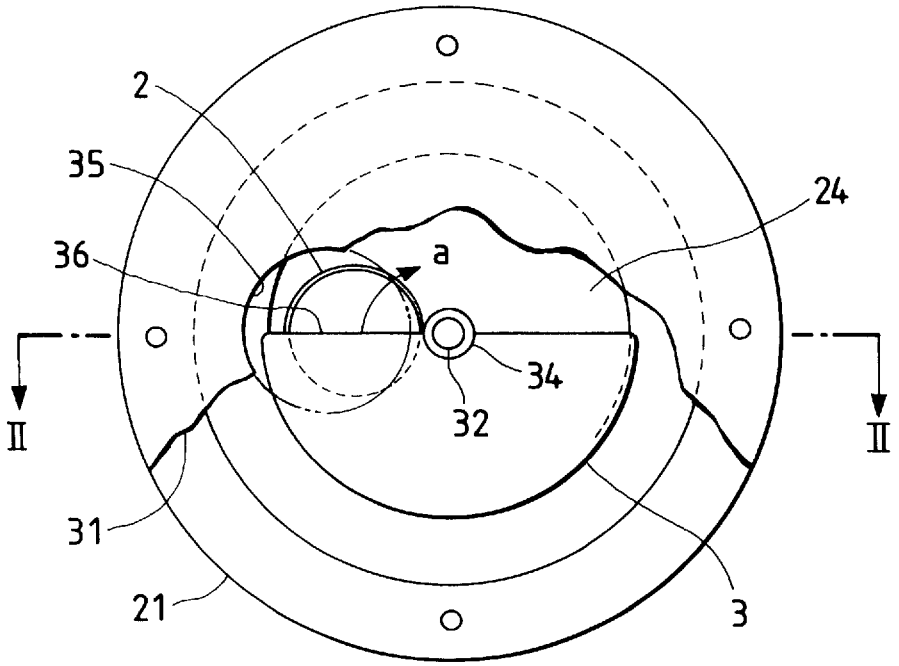
FIG. 3 is a front view of the pulse air jet generator according to the first embodiment, with parts partially cutaway.

FIGS. 1 to 3 show a pulse air jet generator 1 according to a first embodiment of the present invention, which mainly includes an air blowoff nozzle 2 and an air flow restricting member 3 provided on a blowoff side 4 of the air blowoff nozzle 2.

The air blowoff nozzle 2 is fixed on an annular frame 21 provided around an opening 7 formed in a bulkhead 6 of a positive pressure section 5 (equivalent to an air chamber 88 in FIG. 11) of an air shower apparatus or the like. The annular frame 21 has a large diameter flange 22 directed to a space on the blowoff side 4 and fixed around the opening 7, and it has also a small diameter flange 23 directed to the inside of the positive pressure section 5 and fixed with a disk-like base plate 24 closing a small diameter side opening of the annular frame 21. The air blowoff nozzle 2 is formed integrally with the base plate 24 while passing through a part of the base plate 24. The air blowoff nozzle 2 has the center axis shifted from the center axis of the base plate 24 (that is, the center axis of the annular frame 21) to the outer peripheral side (rightward in a front view) of the base plate 24.

The air flow restricting member 3, which is formed in a semi-circular shape, is positioned at the inner center portion of a disk-like front cover 31 fixed around the opening 7 together with the large diameter flange 22 of the annular frame 21, and it is rotatably supported through a bearing 33 on a boss 34 provided around a shaft 32 projecting in parallel to a blowoff direction (C1) of the air blowoff nozzle 2.

The air flow restricting member 3 is fixed or integrated on the boss 34 in such a manner as to be inclined at an inclination angle $\alpha$ with respect to an imaginary rotational surface perpendicular to a rotational axial line (C0 ). As a result, the air flow restricting member is set with the inclination angle a with respect to the rotational direction.

As will be described in detail later, the air flow restricting member 3 has a function of restricting an air flow blown off from the air blowoff nozzle 2 or changing the direction of the air flow, and a function of rotating it on its axis by the air flow, and consequently it is different from a general runner having only the latter function. Accordingly, although the air flow restricting member 3 is inclined in both the rotational direction and the air blowoff direction to obtain a specified rotational force, it has not necessarily the inclination angle $\alpha$ over the entire surface. The air flow restricting member 3 may be formed with a spiral surface centered on the rotational axial line (C0 ).

The front cover 31 has an air blowoff port 35 at a position corresponding to that of the air blowoff nozzle 2. A space 25 formed in the annular frame 21 is communicated to the space on the blowoff side 4 via the air blowoff port 35 and is also communicated to the positive pressure section 5 via the air blowoff nozzle 2.

The function of the pulse air jet generator 1 having the above configuration will be described below.

Figure 11:
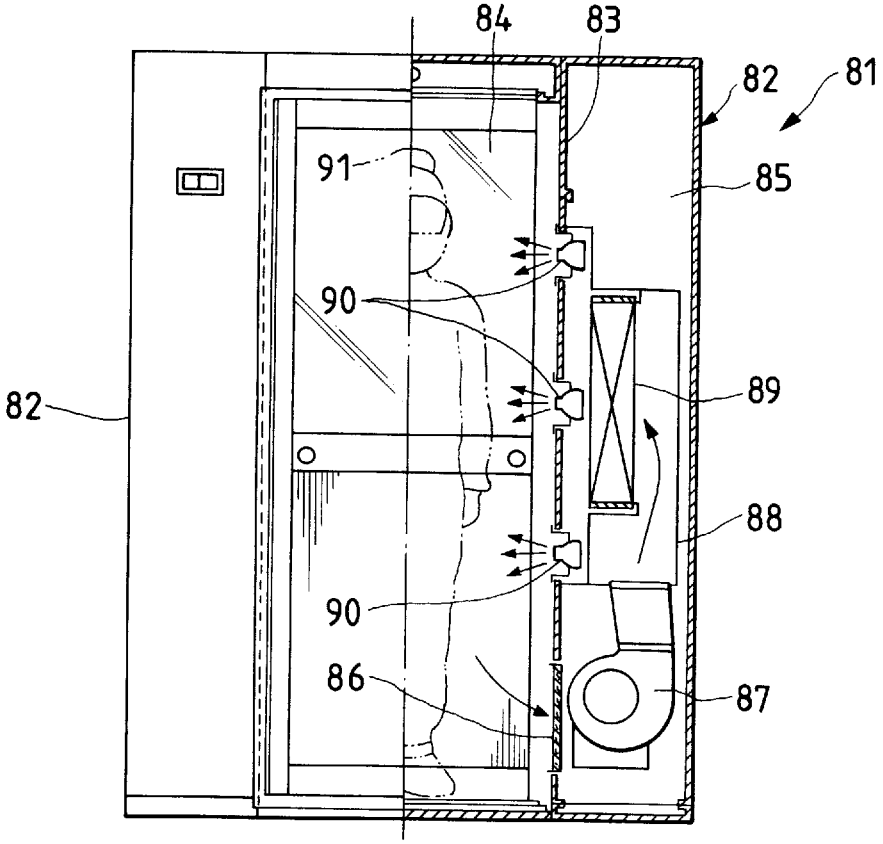
FIG. 11 PRIOR ART
FIG. 11 is a top view of a conventional air shower apparatus, with the half portion thereof cutaway.
Figure 12:
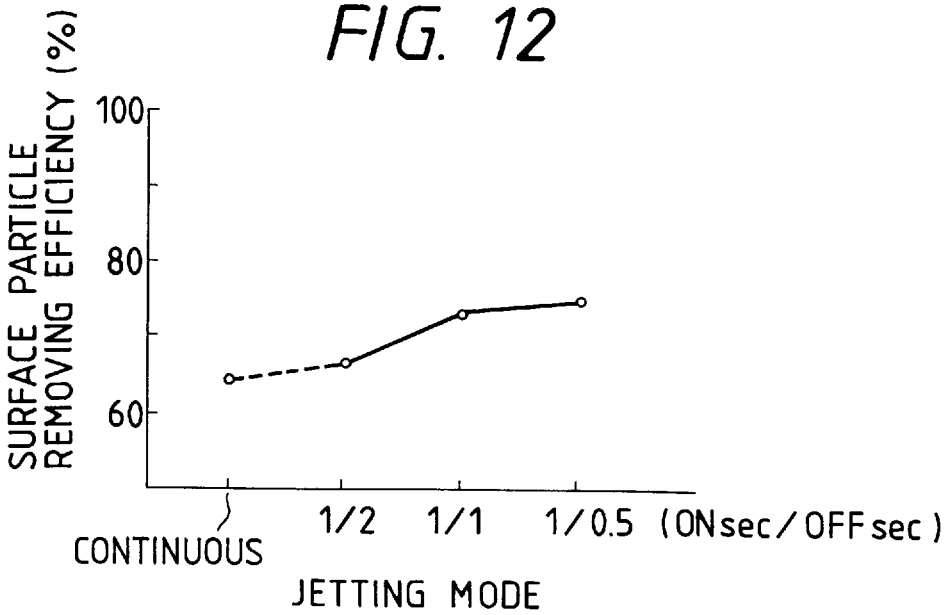
FIG. 12 is a graph showing a relationship between dust removal efficiencies and jetting modes.

When the inside of the positive pressure section 5 (equivalent to the air chamber 88) is pressurized, for example, by operation of a blower indicated by reference numeral 87 in FIG. 11, an air is blown off from the air blowoff nozzle 2 to the blowoff side 4 (air shower chamber 84 in FIG. 11).

The air strikes one side edge portion 36 of the air flow restricting member 3 positioned in front of the air blowoff nozzle 2, so that the air flow restricting member 3 rotates in the direction shown by an arrow "a". After rotating about a half turn, the air blowoff restricting member 3 is out of the front side of the air blowoff nozzle 2 as shown by reference numeral 3' in FIG. 4; however, it continuously rotates due to the inertial force until the side edge portion 36 is positioned again in front of the air blowoff nozzle 2. In this way, the air flow restricting member 3 continuously rotates and thereby it is intermittently positioned in front of the air blowoff nozzle 2. When the air flow restricting member 3 is out of the front side of the air blowoff nozzle 2, the air is blown off forward through the air blowoff port 35. On the other hand, when it is positioned in front of the air blowoff nozzle 2, the air flow, which is blown off forward from the air blowoff nozzle 2 via the air blowoff port 35, is cut off and the air blowoff pressure is significantly reduced as compared with the state that the air flow restricting member 3 is out of the front side of the air blowoff nozzle 2; and in this state, since the air flow changed in direction and diffused along the air flow restricting member 3 is temporarily enclosed in the space 25 formed by the annular frame 21 and the front cover 31, the air flow is positively cut off and the blowoff pressure generated when the air flow restricting member 3 is subsequently out of the air blowoff nozzle 2 is increased. In this way, the air flow blown off from the air blowoff nozzle 2 is pulsative.

Such a pulsative air flow, that is, a pulse air jet is blown to the person 91 in the air shower chamber 84. As a result, vibrations similar to those generated when the person 91 repeatedly beats the cloth by the hands are given to dust particles adhering on the cloth, to thus rapidly remove the dust particles remaining directly after start of air jetting.

The air flow restricting member 3 must be positioned in front of the air blowoff nozzle 2 at start of air blowoff, and also it must be given such an angular displacement as to allow continuous rotation by the initial action. In this regard, the angular displacement of the air flow restricting member 3 in this embodiment is reset to the original position by the dead weight when the air blowoff is stopped because the air flow restricting member 3 is formed of one semi-circular air flow restricting plate. For the air flow restricting member 3 formed of two or more of plates, the weight of the air flow restricting plates may be unbalanced or an eccentric weight may be provided on either of the plates for resetting the angular displacement of the air flow restricting member to the original position.

Figure 4:
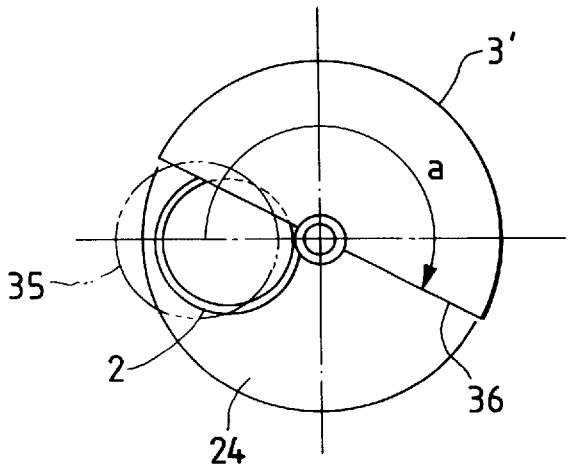
FIG. 4 is a front view of essential portions of the pulse air jet generator according to the first embodiment, showing a state in which an air flow restricting member is rotated.
Figure 5A:
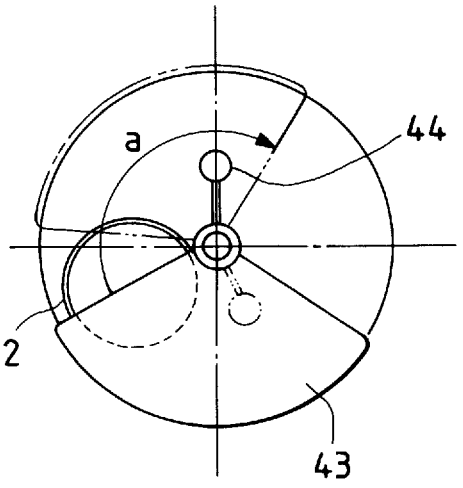
Figure 5B:
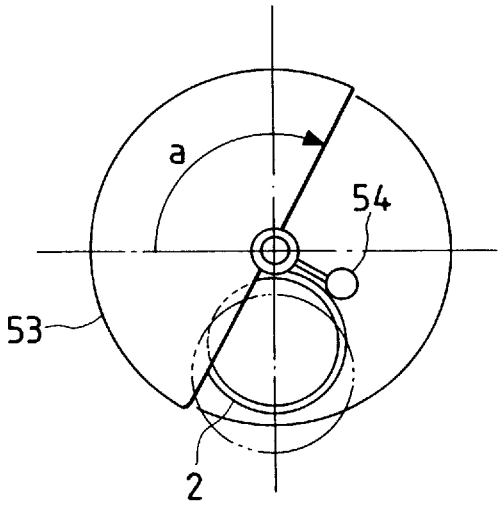

As described above, the air flow restricting member 3 in this embodiment is rotated up to the position shown in FIG. 4 by the initial action due to the air blowoff because it is formed in a semi-circular shape and has the leading side edge portion 36 in the rotational direction which is positioned in front of the air blowoff nozzle 2 when the air blowoff is stopped. Consequently, the air flow restricting member 3 in this embodiment is able to continuously rotate only by the dead weight without any inertial force. However, in the case where the air flow restricting member is not given the initial displacement enabling continuous rotation only by the dead weight, for example, in the case of the air flow restricting member indicated by reference numeral 43 in FIG. 5A in which it is formed in a fan shape having a center angle of 180° or less (120° in FIG. 5A) or in the case of the air flow restricting member indicated by reference numeral 53 in FIG. 5B in which it is formed in a semi-circular shape but the air blowoff nozzle 2 is positioned under the rotational center C0, a weight 44 (54) lighter than the air flow restricting member 43 (53) is provided on the opposed side of the air flow restricting member 43 (53) for making easy the inertial rotation, thereby positively starting and rotating the air flow restricting member 43 (53). In addition, the air flow restricting member formed of a fan shaped plate having a center angle of 180° or more, can be positively started but it presents a problem that the blowoff time in one cycle is shortened.

The frequency of the pulse and the time distribution of ON/OFF in one cycle in the above-described pulse air jet are determined in accordance with the center angle and the division number of the semi-circular or fan shaped air flow restricting member 3, 43 or 53, the blowoff velocity (blowoff pressure) of the air blowoff nozzle 2, and the like. Thus, a pulse jet suitable for the application can be generated by setting the above factors. In particular, a high frequency pulse air jet, which was impossible to be generated by the conventional type generator using a solenoid valve or damper, can be easily generated.

In the pulse air jet generator 1 shown in the figures, a holder of an air blowoff nozzle 90 of the conventional air shower apparatus 81 shown in FIG. 11 can be used as the annular frame 21. Accordingly, the pulse air jet generator 1 can be fixed to the existing apparatus without addition of any secondary machining, design change and the like to the existing apparatus. Thus, the pulse air jet generator exhibiting a high dust removing effect according to the present invention can be easily realized at a low cost.

Other embodiments of the present invention will be described with reference to the drawings.

Figure 6:
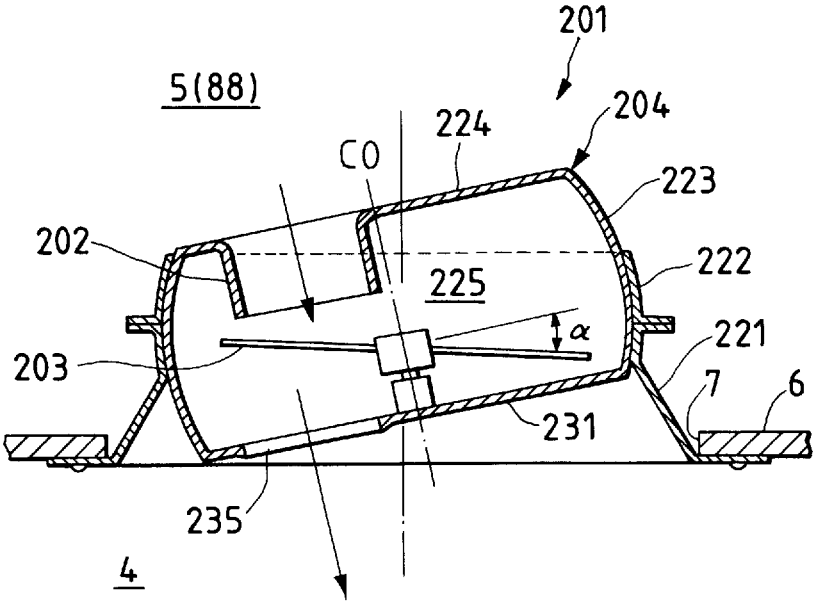
FIG. 6 is a sectional plan view of a pulse air jet generator capable of changing the blowoff direction according to a second embodiment of the present invention, showing a state in which the blowoff direction is changed.

FIG. 6 shows a pulse air jet generator 201 according to a second embodiment of the present invention, which includes a movable hollow nozzle member 204 turnably supported by an annular frame 221 fixed around an opening 7 of a bulkhead 6 of a positive pressure section. More specifically, a spherical surface portion 223 formed around the outer periphery of the movable nozzle member 204 is turnably held on an annular, inner spherical surface of a holder portion 222 formed on a base portion of the annular frame 221. An air blowoff nozzle 202 is formed in an air introduction portion 224 of the movable nozzle member 204, and an air blowoff port 235 is opened in a front cover portion 231 provided on the blowoff side of the air blowoff nozzle 202 at a position corresponding to that of the air blowoff nozzle 202. An air flow restricting member 203, which crosses the air flow blown off from the air blowoff nozzle 202 intermittently at part of the rotational locus thereof, is turnably provided in an inner cavity 225 formed between the air introduction portion 224 and the front cover portion 231.

The pulse air jet generator 201 is able to not only generate a pulse air jet as in the first embodiment but also change the blowoff direction of the pulse air jet by turning the movable nozzle member 204.

Figure 7:
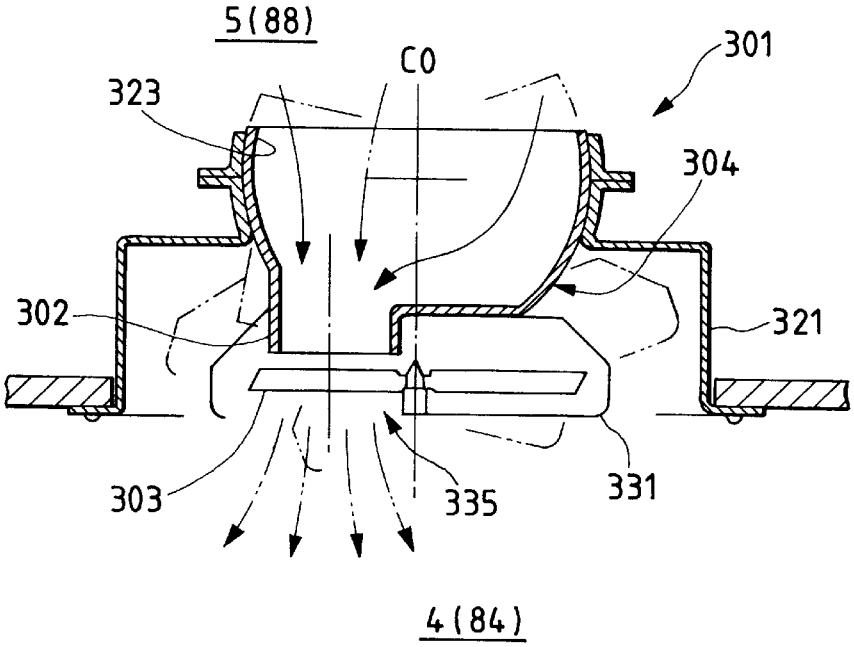
FIG. 7 is a sectional plan view of a pulse air jet generator according to a third embodiment of the present invention.

FIG. 7 shows a pulse air jet generator 301 according to a third embodiment of the present inventions which includes a movable nozzle member 304 having a spherical surface portion 323 supported by a spherical portion of an annular frame 321 and also having an air blowoff nozzle 302 formed at a position shifted outward from the center of the movable nozzle member 304. An air flow restricting member 303 formed of two runners and a front cover 331 having an air blowoff port 335 are provided on a blowoff side 4 of the movable nozzle member 304. The pulse air jet generator 301 can be applied to the conventional air shower apparatus 81 shown in FIG. 11 only by replacement of the nozzle 90 with the pulse air jet generator 301.

Figure 8:
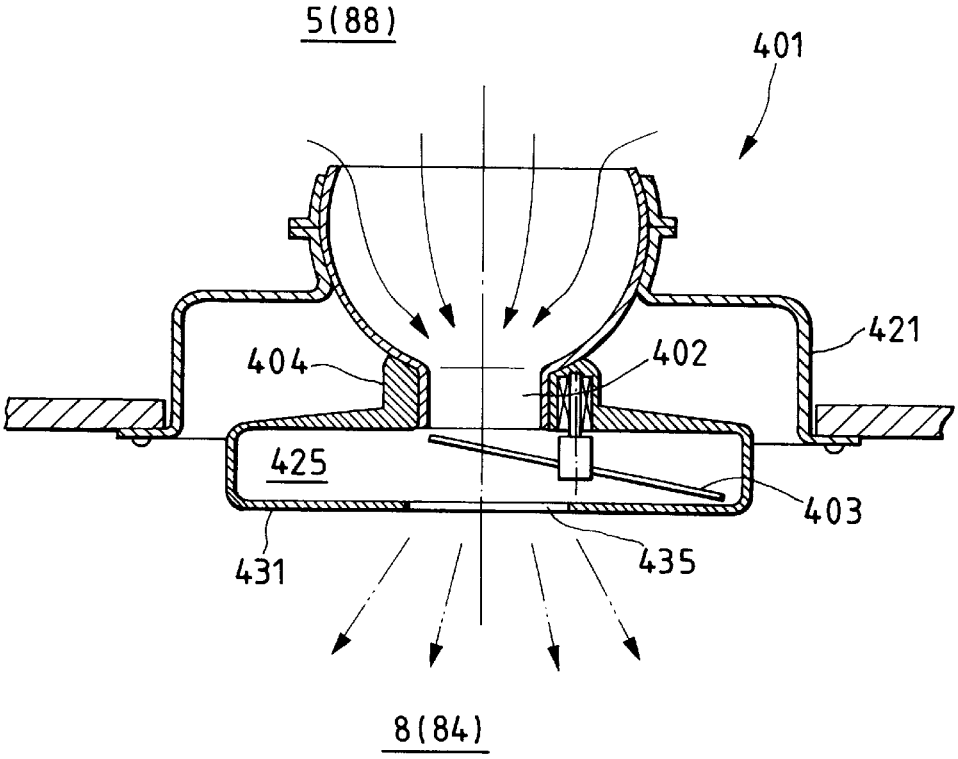
FIG. 8 is a sectional plan view of a pulse air jet generator according to a fourth embodiment of the present invention.

FIG. 8 shows a pulse air jet generator 401 according to a fourth embodiment of the present invention, in which an air flow restricting member 403 is provided in an inner cavity 425 of a hollow disk-like unit 404 fitted and fixed to the leading end of an air blowoff nozzle 402 having the same shape as that of the conventional nozzle 90, and an air blowoff port 435 is opened in a front cover portion 431. The pulse air jet generator 401 can be applied to the conventional air shower apparatus only by mounting the unit 404 to the conventional nozzle 90.

To mount the above pulse air jet generator 401 to the air blowoff nozzle 402 in a state being accommodated in the annular frame 421, the air flow restricting member 403 is desirable to be small in diameter. However, in some cases, particularly, for air flow restricting members having some shapes, if the member is reduced in diameter, the rotational number of the member would be increased and thereby an effect of cutting off the air flow would be reduced, failing to generate the pulse.

To cone with such an inconvenience, the pulse air jet generator 1 according to the first embodiment shown in FIG. 1 uses the air flow restricting member 3 formed of one semi-circular shaped plate for positively generating the pulse. In addition to such an embodiment, there can be proposed the following configuration capable of positively generating the pulse using an air flow restricting member having a small diameter.

Figure 9A:
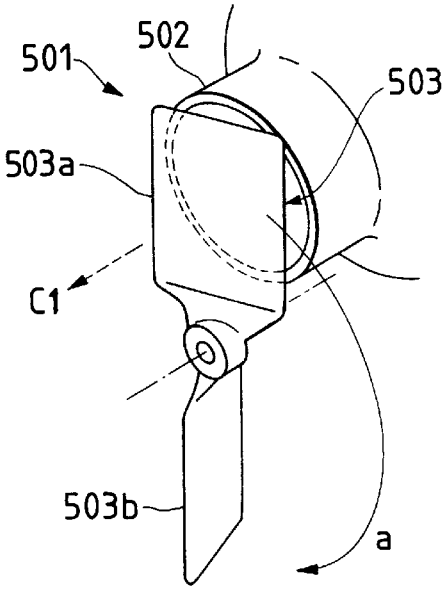
FIG. 9A is a perspective view of essential portions of a pulse air jet generator according to a fifth embodiment of the present invention.
Figure 9B:
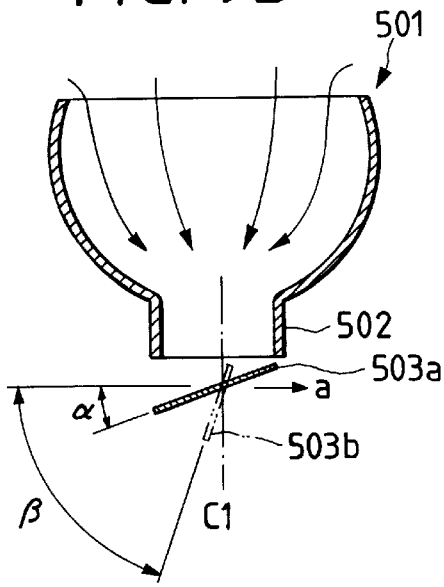
FIG. 9B is a sectional plan view of essential portions of the pulse air jet generator shown in FIG. 9A.

FIGS. 9A and 9B show a pulse air jet generator 501 according to a fifth embodiment of the present invention, which includes, on the blowoff side of an air blowoff nozzle 502, an air flow restricting member 503 formed of two runners 503*a* and 503*b* having different inclination angles α and β with respect to a rotational direction "a" perpendicular to an air blowoff direction C1.

The inclination angle α of the runner 503*a* of the air flow restricting member 503 is preferably set to be in a range of 45° or less (about 20° in FIGS. 9A and 9B) in order that the runner 503 obtains a rotational force in a specified direction "a" by the blowoff air flow and cuts off the blowoff air flow. Besides, the inclination angle β of the runner 503*b* is preferably set to be as large as possible in a range of 90° or less (about 70° in FIGS. 9A and 9B) in order that the runner 503*b* does not cut off the blowoff air flow if possible and obtains the lowest rotational force in the specified rotational direction "a" by the blowoff air flow. In addition, as described above, it is necessary to position the runner 503*a* in front of the air blowoff nozzle 502 at start of the air blowoff by means of, for example, making the weight of the runner 503*b* opposite to the runner 503*a* larger than the runner 503*a*.

In the pulse air jet generator 501 having the above configuration, the air flow restricting member 503 is rotated in the direction "a" by striking of the air blown off from the air blowoff nozzle 502 to the runner 503*a*, and the two runners 503*a* and 503*b* are alternately positioned in front of the air blowoff nozzle 502.

When the runner 503*a* having the small inclination angle a is positioned in front of the air blowoff nozzle 502, the energy of the blow off air flow is consumed to rotate the air flow restricting member 503 and to accelerate it up to a rational speed corresponding to the inclination angle α, and at the same time the blowoff pressure is made relatively small by cutoff or dispersion of the blowoff air flow.

On the other hand, when the runner 503*b* having the large inclination angle β is positioned in front of the air blowoff nozzle 502, the blowoff air flow is little cut off and is jetted forward; however, the air flow restricting member 503 is decelerated up to a rotational speed corresponding to the inclination angle β.

Thus, in the pulse air jet generator 501, although the air flow restricting member 503 is formed of the two runners 503*a* and 503*b*, it generates substantially one pulse of the blowoff air flow for each rotation; and further it has a function that the rotational speed thereof is suppressed by the decelerating action of the runner 503*b* having the large inclination angle β (the runner 503*b* acts as an air resistor not only against the blowoff air flow but also in the rotational direction). The air flow restricting member 503, which has a small diameter, is able to generate a positive pulse air jet having a relatively low frequency by the above combined actions. Although the air flow restricting member 503 is formed of the two runners 503*a* and 503*b* in this embodiment, it may be formed of three or more of runners, and preferably, it is formed of the two runners 503*a* and 503*b* which are further added with the runner 503*b* having the large inclination angle β.

In the pulse air jet generator in each of the above-described embodiments, the air flow restricting member is reset in front of the air blowoff nozzle by the dead weight of the air flow restricting member; however, it can be started in accordance with the following configuration.

Figure 10A:
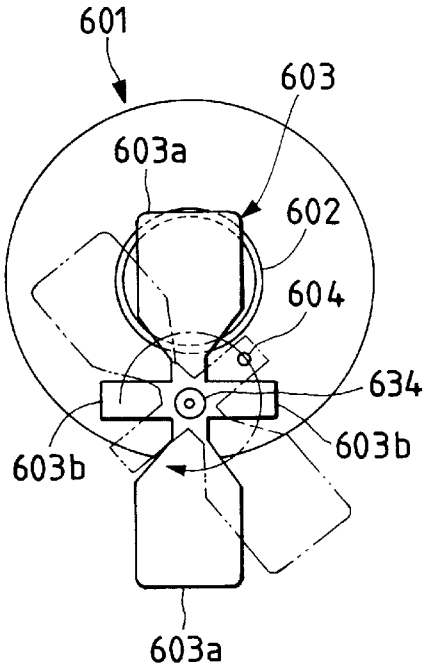
FIG. 10A is a front view of essential portions of a pulse air jet generator according to a sixth embodiment of the present invention.
Figure 10B:
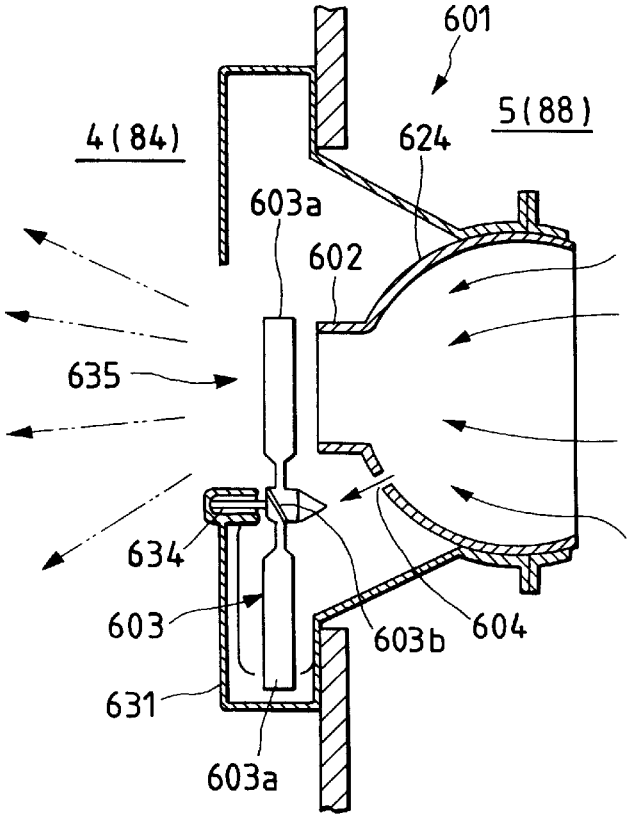
FIG. 10B is a sectional side view of FIG. 10A.

FIGS. 10A and 10B show a pulse air jet restricting member according to a sixth embodiment of the present invention, which includes an air flow restricting member 603 having two air flow restricting plates 603*a*, 603*a* and two starting small runners 603*b*, 603*b* each of which is provided at an intermediate position between the air flow restricting plates 603*a*, 603*a*. The air flow restricting plate 603*a* entirely crosses an air flow blown off from an air blowoff nozzle 602 intermittently at part of the rotational locus thereof. On the other hand, the runner 603*b* little cuts off the blowoff air flow but receives the air flow to such an extent as to generate a rotational force.

A small air jet port 604 is provided on rotational loci of center side portions of the small runners 603*b*, 603*b* and the air flow restricting plates 603*a*, 603*a* at a position where neither of them is positioned in front of the air blowoff nozzle 602, that is, at a position shifted about a half pitch from the state where either of them is positioned in front of the air blowoff nozzle 602. In the embodiment shown in FIGS. 10A and 10B, the small air jet port 604 having such a diameter as not to give adverse effect on the main blowoff air flow is provided in a spherical surface portion 624 of the air blowoff nozzle 602.

In the pulse air jet generator 601 having such a configuration, if either of the two air flow restricting plates 603*a*, 603*a* and the two runners 603*b*, 603*b* is positioned in front of the air blowoff nozzle 602 upon starting, then it receives the main blowoff air flow to generate a rotational force of the air flow restricting member 603. On the other hand, if neither of them is positioned in front of the air blowoff nozzle 602, then either of them is positioned in front of the small air jet port 604 and it receives an air flow blown off from the small air jet port 604 to generate a rotational force of the air flow restricting member 603.

In the air flow restricting member 603 of the pulse air jet generator 601, only the two air flow restricting plates 603*a*, 603*a* function to cut off the main blowoff air flow for making pulsative the air flow, so that two pulses of the air flow are generated for each rotation of the air flow restricting plate 603*a*.

In the above embodiment, the air flow restricting member 603 includes the two air flow restricting plates 603*a*, 603*a* and the two small runners 603*b*, 603*b*; however, it may include one air flow restricting plate and two or three, or three or more of starting small runners.

Although a rotational shaft 634 of the air flow restricting member 603 is positioned under the air blowoff nozzle 602 in the above embodiment, the relative positional relationship between the air flow restricting member and the air blowoff nozzle is not limited thereto. Moreover, each of the pulse air jet generators 1, 201, 301, 401, 501 and 601 can be applied to various air jet nozzles, in addition to the air shower apparatus.

Next, the dust removing effect of an air shower apparatus to which the pulse air jet generator of the present invention is applied will be examined on the basis of experimental data.

Figure 13:
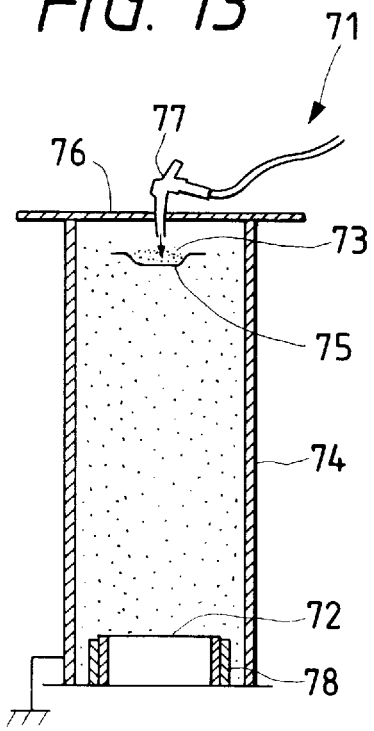
FIG. 13 is a vertical sectional view showing a dusting apparatus used for an experiment made for examining the performance of the pulse air jet generator of the present invention.

The experiment was made in accordance with the following procedure. First, dust particles 73 are made to adhere on the surface of a dust-free cloth (polyester based cloth) 72 by a dusting device 71 shown in FIG. 13, to form a sample. The dusting device 71 includes a cylindrical duct 74 having an inner surface made of aluminum and connected to an earth line for preventing electrification; a receiving dish 75 provided in the duct 74 at a position near the upper end thereof; and an air gun 77 passing through a lid 76 closing the upper end of the duct 74 and positioned opposite to the receiving dish 75. The dust-free cloth 72 fixed on a circular supporting frame 78 (embroider frame) was disposed on the inner bottom portion of the duct 74. In this experiment, the duct 74 has a diameter of 200 mm and a height of 1 m, and the supporting frame 78 has a diameter of 150 mm. The dust particles 73 placed on the receiving dish 75 in an amount of 0.1 g were dropped in the duct 74 using the air gun 77, and were made to adhere on the dust-free cloth 72, to form a sample.

The sample composed of the dust-free cloth 72 on which the dust particles 73 were made to adhere was subjected to air jetting using the air shower apparatus 81 shown in FIG. 11 in which the air jet nozzle 90 portion was replaced with the pulse air jet generator 1 according to the first embodiment of the present invention shown in FIGS. 1 and 2. At this time, the sample was fixed at a position apart 200 mm from the blowoff side of the air shower apparatus 81 in a state being perpendicular to the blowoff direction.

With respect to the sample thus obtained, dust amounts D1, D2 before and after air jetting were measured by a tumbling chamber method, and a dust removing efficiency η (%) was determined on the basis of the following equation.

$$\eta=(1-D2/D1)\times 100(\%)$$

Figure 14:
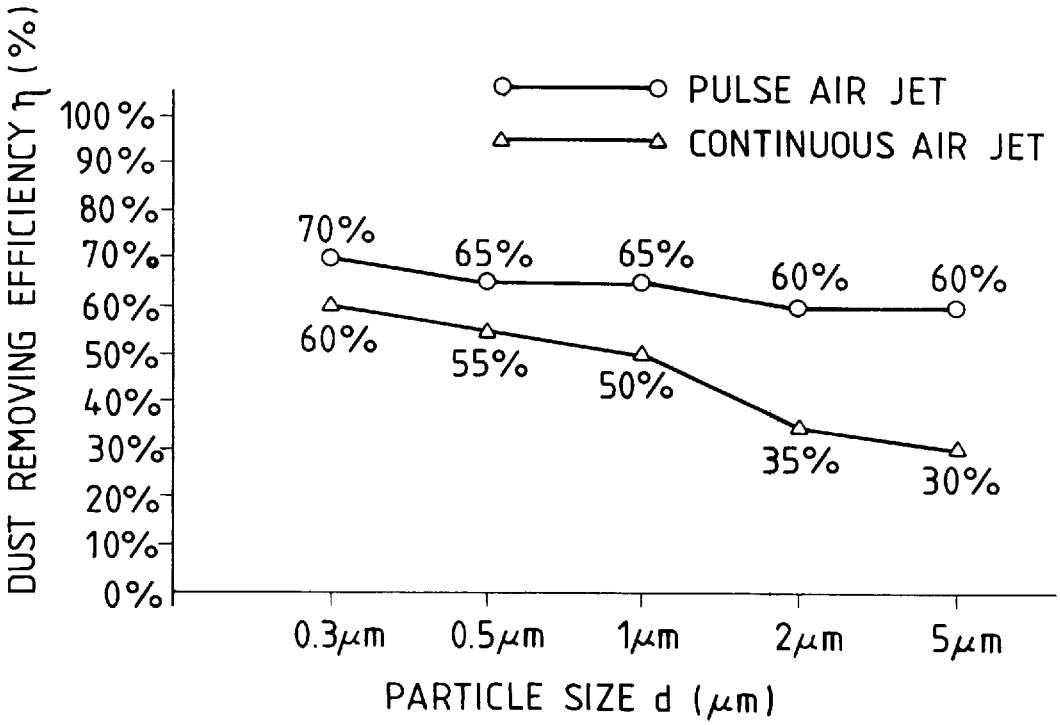
FIG. 14 is a graph showing a relationship between dust removing efficiencies and particle sizes of dust.

In this experiment, five kinds of the dust particles 73 having an average particle size of 0.3 μm, 0.5 μm, 1 μm, 2 μm, and 5 μm were used, and the measurement was repeated three times for each average particle size and the average value thereof was taken as a measured value. A comparative experiment was performed for the conventional continuous air jetting type air blowoff nozzle 90 in the same manner as described above. These experimental results are shown in FIG. 14.

The experimental results show that the air shower apparatus provided with the pulse air jet generator 1 of the present invention is superior to the conventional continuous air jetting type air shower apparatus. More specifically, according to the present invention, the dust removing efficiency η is improved for all of the average particle sizes "d", and particularly, it is significantly improved for the dust particles having the average particle sizes of from 2 μm to 5 μm.

The pulse air jet generator of the present invention having the above configuration exhibits the following effects:

(1) The pulse air jet generator of the present invention includes an air flow restricting member, provided on the blowoff side of an air blowoff nozzle rotatably around a shaft being substantially in parallel to the blowoff direction, for crossing an air flow blown off from the air blowoff nozzle intermittently at part of the rotational locus of the air flow restricting member; wherein the air flow restricting member has partially or entirely an inclination angle with respect to the rotational direction thereof and is rotatable by the air flow blown off from the air blowoff nozzle. Accordingly, the manufacturing cost and running cost can be reduced because of its simple structure without provision of any additional power source, and a pulse air jet having a desired frequency can be obtained while noise is kept at a low level. As a result, when applied to an air shower apparatus or the like, the pulse air jet generator of the present invention is able to significantly improve the dust removing efficiency.

(2) The pulse air jet generator of the present invention is also so configured that the air flow restricting member is formed of one or more of plates and the weight of a rotational portion containing the air flow restricting member is unbalanced so that the plate or one of the plates of the air flow restricting member is reset to a position corresponding to that of the air blowoff nozzle by the dead weight when the air blowoff is stopped. With this configuration, it is possible to positively generate a pulse air jet simultaneously with the air blowoff from the air blowoff nozzle upon start of an air shower apparatus or the like, without provision any additional power source, a synchronization means and the like.

(3) The pulse air jet generator of the present invention is also so configured that the air flow restricting member is formed of one plate formed in a substantially semi-circular shape in a front view and is positioned at a lower half of the rotational locus thereof by the dead weight in a state that the air blowoff is stopped; and the air blowoff nozzle is disposed at a position, shifted sideward of the rotational center of the air flow restricting member, where the air blowoff nozzle is overlapped to the leading edge of the air flow restricting member in the rotational direction. With this configuration, it is possible to ensure the starting and rotation of the air flow restricting member due to the air flow blowoff, and to equalize the time distribution of ON/OFF of the air blowoff and maximize a difference in pressure between ON/OFF of the air blowoff. As a result, when applied to an air shower apparatus, the pulse air jet generator of the present invention makes it possible to give large vibrations to dust particles and hence to exhibit an excellent dust removing effect.

(4) The pulse air jet generator of the present invention is also so configured that the air blowoff nozzle is disposed in an annular frame at a position shifted to the outer peripheral side from the center of the annular frame, the annular frame being formed in a substantially cylindrical shape or in a substantially conical shape with the head cutoff and fixed on an air blowoff portion; and the rotational center of the air flow restricting member is positioned at the center of the annular frame or in the vicinity thereof. With this configuration, the rotational diameter of the air flow restricting member is maximized with respect to the diameter of the annular frame, so that a pulse air jet having a large difference in pressure between ON/OFF of air flow blowoff at a relatively low frequency can be generated, resulting in the increased dust removing efficiency. Also, the diameter of the annular frame is minimized with respect to the air flow restricting member having the same performance, and accordingly, the pulse air jet generator of the present invention is advantageous in the case of being mounted in a limited space of a nozzle portion of an air shower apparatus or in the case of making small in size of the apparatus.

(5) The pulse air jet generator of the present invention is also so configured as to include a front cover which is provided on the blowoff side of the air blowoff nozzle and which has an air blowoff port provided at a position corresponding to that of the air blowoff nozzle, wherein the air flow restricting member is disposed in a space formed between the front cover and the air blowoff nozzle. With this configuration, the air flow changed in direction and dispersed by the air flow restricting member is enclosed in the above space, so that an effect of cutting off the blowoff air flow by the air flow restricting member is enhanced and also the impact force of the pulse air jet is increased because the pressure upon air blowoff is enhanced, resulting in the increased dust removing effect.

(6) The pulse air jet generator of the present invention is also so configured as to include a movable nozzle member having an outer spherical surface portion supported by an inner spherical surface portion of the annular frame fixed on the air blowoff portion, wherein the air blowoff nozzle and the front cover having the air blowoff port are integrally formed on the air introduction side and the air blowoff side of the movable nozzle member respectively, and the air flow restricting member is disposed between the air blowoff nozzle and the front cover. With this configuration, it is possible to generate a pulse air jet having an excellent dust removing effect and also to change the blowoff direction of the pulse air jet; and further, since the positional relationship between the air blowoff nozzle, air flow restricting member and the air blowoff port of the front cover is fixed upon air blowoff, it is possible to usually generate the optimum pulse air jet irrespective of the blowoff direction.

What is claimed is:

1. A pulse air jet generator comprising:

an air flow restricting member, provided on the blowoff side of an air blowoff nozzle, rotatably around a shaft being substantially in parallel to the blowoff direction and disposed at a position shifted sideward of the rotational center of said air flow restricting member, for intermittently crossing an air flow blown from said air blowoff nozzle at part of the rotation locus of said airflow restricting member to deflect air flow when said air flow restricting member crosses said air blowoff nozzle;

wherein said air flow restricting member has partially or entirely an inclination angle with respect to the rotational direction thereof and is rotable by the air blow from said air blowoff nozzle.

2. A pulse air jet generator according to claim 1, wherein said air flow restricting member is formed of one or more of plates and the weight of a rotational portion containing said air flow restricting member is unbalanced so that the plate or one of the plates of said air flow restricting member is reset to a position corresponding to that of said air blowoff nozzle by the dead weight when the air flow is stopped.

3. A pulse air jet generator according to claim 2, wherein said air flow restricting member is formed of one plate formed in a substantially semi-circular shape in a front view and is positioned at a lower half of the rotational locus thereof by the dead weight in a state that the air flow is stopped so that said air blowoff nozzle is overlapped to the leading edge of said air flow restricting member in the rotational direction.

4. A pulse air jet generator according to one of the claim 1, 2 or 3 wherein said air blowoff nozzle is disposed in an annular frame at a position shifted to the outer peripheral side from the center of said annular frame, said annular frame being formed in a substantially cylindrical shape or in a substantially conical shape with the head cutoff and fixed on an air blowoff portion; and the rotational center of said air flow restricting member is positioned at the center of said annular frame or in the vicinity thereof.

5. A pulse air jet generator according to one of the claim 1, 2 or 3, further comprising a front cover which is provided on the blowoff side of said air blowoff nozzle and which has an air blowoff port provided at a position corresponding to that of said air blowoff nozzle, wherein said air flow restricting member is disposed in a space formed between said front cover and said air blowoff nozzle.

6. A pulse air jet generator according to claim 5, further comprising a movable nozzle member having an outer spherical surface portion supported by an inner spherical surface portion of said annular frame fixed on the air blowoff portion, wherein said air blowoff nozzle and said front cover having said air blowoff port are integrally formed on the air introduction side and the air blowoff side of said movable nozzle member respectively, and said air flow restricting member is disposed between said air blowoff nozzle and said front cover.

* * * * *